US010927863B2

(12) United States Patent
Steindl

(10) Patent No.: US 10,927,863 B2
(45) Date of Patent: Feb. 23, 2021

(54) HYDRAULIC ROTATIONAL DRIVE

(71) Applicant: EPSILON Kran GmbH, Salzburg (AT)

(72) Inventor: Johannes Steindl, Elsbethen (AT)

(73) Assignee: EPSILON Kran GmbH, Salzburg (AT)

( * ) Notice: Subject to any disclaimer, the term of this patent is extended or adjusted under 35 U.S.C. 154(b) by 0 days.

(21) Appl. No.: 15/950,737

(22) Filed: Apr. 11, 2018

(65) Prior Publication Data

US 2018/0297823 A1 Oct. 18, 2018

(30) Foreign Application Priority Data

Apr. 12, 2017 (EP) ..... 17166255

(51) Int. Cl.
*F15B 15/28* (2006.01)
*E02F 3/36* (2006.01)

(52) U.S. Cl.
CPC ..... *F15B 15/2815* (2013.01); *E02F 3/3681* (2013.01)

(58) Field of Classification Search
CPC ..... E02F 3/3681
See application file for complete search history.

(56) References Cited

U.S. PATENT DOCUMENTS 7,735,530 B1 6/2010 Riha et al.

FOREIGN PATENT DOCUMENTS

| | | |
|---|---|---|
| EP | 2 460 758 | 6/2012 |
| JP | 63-048790 | 4/1988 |
| JP | 03-089756 | 9/1991 |
| JP | 2015-140233 | 8/2015 |
| KR | 10-2010-0118762 | 11/2010 |
| SU | 152948 | 10/1961 |
| WO | 2013/025141 | 2/2013 |
| WO | 2016/099372 | 6/2016 |
| WO | 2018/038675 | 3/2018 |

OTHER PUBLICATIONS

Search Report dated Oct. 4, 2017 in European Application No. 17 16 6255, with English translation.

*Primary Examiner* — F Daniel Lopez
(74) *Attorney, Agent, or Firm* — Wenderoth, Lind & Ponack, L.L.P.

(57) ABSTRACT

A hydraulic rotational drive for rotating load-handling equipment relative to a crane arm includes a shaft, which has a first securing element for connecting the shaft to the load-handling equipment or the crane arm, a shaft bearing, which has second securing element for connecting the shaft bearing to the crane arm or the load-handling equipment, vanes arranged in the shaft which can be acted on by oil via an oil feed, and an oil discharge for the transmission of a torque to the shaft. The rotational drive also has a rotary encoder for the detection of the angular position of the shaft relative to the shaft bearing.

11 Claims, 10 Drawing Sheets

HYDRAULIC ROTATIONAL DRIVE

BACKGROUND OF THE INVENTION

The invention relates to a hydraulic rotational drive.

In generic rotational drives, such as are used for example in cranes for the rotatable installation of load-handling equipment, the detection of the angular position of the rotational drive often presents difficulties. The angular position of the rotational drive has to be effected visually by a user, for example, which can also require a clear view of the rotational drive or free access to the rotational drive. This can have a negative effect on the process of installing load-handling equipment on the rotational drive as well as on the operation of load-handling equipment installed on a crane via a conventional rotational drive.

A rotational drive of the general kind is known, for example, from EP 2460758 A1.

WO 2016/099372 A1 shows a rotational drive which comprises a device for determining the absolute angular position of the rotational drive, and the device is provided in the form of a magnetic ring encircling the rotational drive and a corresponding sensor. Therein, the rotational drive pierces through the device for determining the angular position. By way of such a concentric arrangement, the device is not positioned in the middle and not centrally in the rotational drive.

SUMMARY OF THE INVENTION

The object of the invention is to specify an improved rotational drive in which the previously mentioned disadvantages do not arise.

This object is achieved by a rotational drive as described below.

As in the case of a generic rotational drive, for rotating load-handling equipment relative to a crane arm, the hydraulic rotational drive according to the invention also has, firstly, a shaft which itself in turn has a first securing element for connecting the shaft to the load-handling equipment or the crane arm. Furthermore, a shaft bearing is provided, which has a second securing element for connecting the shaft bearing to the crane arm or the load-handling equipment. For driving the rotational drive, vanes arranged in the shaft are provided which can be acted on by oil via an oil feed and an oil discharge for the transmission of a torque to the shaft. The hydraulic rotational drive can, in general, be driven via hydraulic equipment, which usually leads from a crane arm to the rotational drive.

In contrast to hydraulic rotational drives known in the state of the art, the hydraulic rotational drive according to the invention additionally has a rotary encoder, which serves to detect the angular position of the shaft relative to the shaft bearing. The angular position of the rotational drive and optionally of load-handling equipment secured to the latter can thus be detected simply and precisely.

The rotary encoder, also called a shaft encoder, can be a mechanical or electrical sensor for the detection of an angle of rotation. Such a sensor can have a rotor and a stator and can generate and output an analogue and/or digital output signal, which is proportional to an angular position of the rotor relative to the stator.

It is envisioned for there to be provided in the shaft and/or in the shaft bearing at least one recess, in which the rotary encoder is at least partially received. The rotary encoder can thereby be arranged in an area protected by the shaft or the shaft bearing and thus damage to the rotary encoder due to external mechanical action can be avoided. An at least partial arrangement of the rotary encoder in the shaft or in the shaft bearing can also enable a compact design of the rotational drive.

The at least one recess can be provided in the middle in the shaft and/or in the shaft bearing. The rotary encoder can thus be mounted in the middle and centrally in the shaft and/or in the shaft bearing (i.e., can be mounted on the central axis). Thereby, the possibility that the rotary encoder is, for example, pierced through by the shaft of the rotational drive can be avoided. Maintenance and mounting of the rotary encoder can thereby be facilitated.

It is advantageous for the rotational drive to have a sliding contact device, which is electrically contacted by a current supply line and a current discharge line. An electrical consumer load, such as electrically operated load-handling equipment or an electrically operated implement for example, arranged on the rotational drive can thereby be supplied with electrical energy. The sliding contact device can also serve for the rotary feedthrough of signal lines.

It is advantageous for the rotary encoder and the sliding contact device to be formed as a combined structural unit. A compact design can thereby be achieved, which can be simply arranged in or on the rotational drive.

Furthermore, it is advantageous for a first recess to be provided in the shaft for the at least partial arrangement of the rotary encoder or of the sliding contact device and for a second recess to be provided in the shaft bearing for the at least partial arrangement of the rotary encoder or of the sliding contact device. Thus, for example, the rotary encoder can be arranged at least partially in the second recess and the sliding contact device can be arranged at least partially in the first recess. The reverse is also conceivable.

In the case in which a recess is arranged in the shaft, it can be advantageous for the recess to be arranged on an end of the shaft facing towards or facing away from the crane arm. Thus, the recess can be realized, for example, as a cavity introduced axially into the material of one of the end faces of the shaft.

It is advantageous for the rotary encoder and/or the sliding contact device to be substantially completely received in the recess. A space-saving arrangement of the rotary encoder or of the sliding contact device inside the rotational drive and good protection against external mechanical influences can thereby be achieved.

It is, in principle, possible for the transmission of the angular position detected by the rotary encoder to a detection device to be effected via cables or wirelessly. The rotary encoder can optionally also be supplied with electricity via cables or wirelessly (for example inductively).

Furthermore, it is advantageous for the current supply line to the sliding contact device to run substantially axially in the shaft and/or to run substantially radially in the shaft bearing, or vice versa. Thus, for example, in the case of an arrangement of the sliding contact device in the shaft bearing, the current supply line thereof can run radially (i.e. laterally for example) or axially (i.e. from above for example) in the area of the shaft bearing. In the case of an arrangement of the sliding contact device in or at an end of the shaft, the current supply line thereof can run radially or axially in the area of the shaft bearing and run axially (i.e. along the longitudinal extent of the shaft for example) or radially in the shaft itself.

It is advantageous for the current supply line to the sliding contact device to run substantially axially and/or radially in the rotary encoder. In the case of an arrangement of the rotary encoder in or on the shaft bearing or in or on the shaft, the current supply line to the sliding contact device can cross the rotary encoder, and this can be effected in the axial and/or radial direction.

In principle, it is advantageous if the shaft projects beyond the shaft bearing at an end of the rotational drive facing towards the load-handling equipment. A securing element for connecting the shaft to the load-handling equipment can thereby be easily reached, for example.

It is also advantageous for the current discharge line from the sliding contact device to be formed at the end of the rotational drive facing towards the load-handling equipment and preferably to lead away from the rotational drive laterally.

It is advantageous for the lateral current discharge line from the sliding contact device to lead away substantially radially or to run diagonally in the direction of the end of the rotational drive facing towards the load-handling equipment.

The shaft can be formed as a rotor, and the shaft bearing can be formed as a stator. The shaft bearing can thus be formed as non-rotatable relative to the crane arm, and the shaft, and optional load-handling equipment arranged on the shaft, can be rotated relative to the fixed shaft bearing.

It is advantageous for at least one part of the rotary encoder to be secured to the shaft bearing, and at least one part of the rotary encoder to be secured to the shaft. Thus, a first part of the rotary encoder can be fixed relative to the shaft bearing and a second part of the rotary encoder can be fixed relative to the shaft. Through a rotation of the shaft relative to the shaft bearing, a rotation of the relevant parts of the rotary encoder with respect to each other can thus take place and consequently be detected.

A crane can have a hydraulic rotational drive as previously described for rotating load-handling equipment relative to a crane arm, in which the crane arm is connected to the second securing element of the hydraulic rotational drive.

Also, a harvester, also called a timber harvester, forest harvester, or crane harvester, can have a crane as previously described.

BRIEF DESCRIPTION OF THE DRAWINGS

Further details and advantages of the present invention are explained in more detail below with the aid of the description of the figures with reference to the embodiments represented in the drawings. In which.

DETAILED DESCRIPTION OF THE INVENTION

Figure 1:
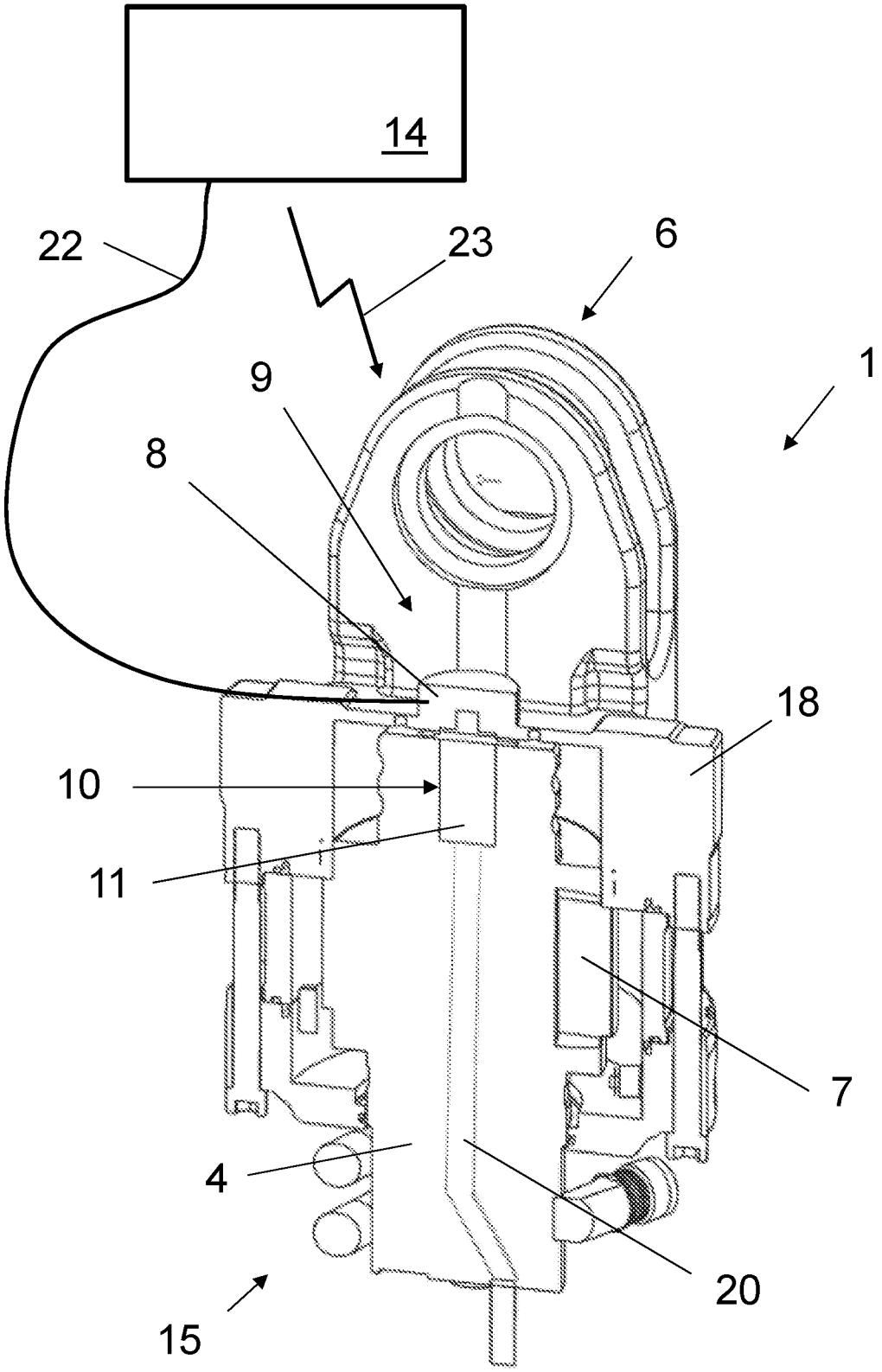
FIG. 1 shows a sectional representation of a first embodiment of a rotational drive.

A section through a first embodiment of a rotational drive 1 is shown in FIG. 1. The lug-type second securing element 6 with which the rotational drive 1 can be secured, for example, to a crane arm 3 (see FIG. 7) can be seen. A rotatable shaft 4, which has vanes 7 which can be acted on by hydraulic oil to drive the shaft 4, is arranged in the shaft bearing 18. The shaft 4 projects out of the shaft bearing 18 at a lower end 15 of the rotational drive 1. In the shaft bearing 18, a first recess 9 is formed on the central axis as shown in FIG. 1, and a rotary encoder 8 is arranged in the first recess 9. In the embodiment shown, the rotary encoder 8 is arranged substantially completely in the first recess 9. Furthermore, in the embodiment shown, the first recess 9 is formed substantially between sides of the lug-type second securing element 6. At an (upper as represented) end of the shaft 4 facing towards the second securing element 6, a second recess 10 is formed on the central axis as shown in FIG. 1, and a sliding contact device 11 is arranged in the second recess 10. In the embodiment shown, the sliding contact device 11 is arranged substantially completely in the second recess 10. For guiding signal lines and/or supply lines, corresponding recesses are provided in the shaft bearing 18 as well as in the shaft 4. In FIG. 1, a recess in the form of the cable duct 20 can be seen in the shaft 4, which, as represented, runs at least in sections substantially axially in the shaft 4. Furthermore, a detection device 14 for the detection of the sensor signals output by the rotary encoder 8 is represented schematically in FIG. 1. The communication between the rotary encoder 8 and the detection device 14, which can be integrated in a crane controller for example, can be effected via cables over a signal line 22 and/or wirelessly via a radio link 23 (such as for instance via Bluetooth, via a radio link according to a standard from the IEEE-802.11 family, or similar). The rotary encoder 8 and the detection device 14 can have corresponding radio modules.

In FIGS. 2 to 6, further embodiments of the rotational drive 1 are shown, wherein analogous to FIG. 1 in each case the rotary encoder 8 is arranged in a recess 9 in the shaft bearing 18.

Figure 2:
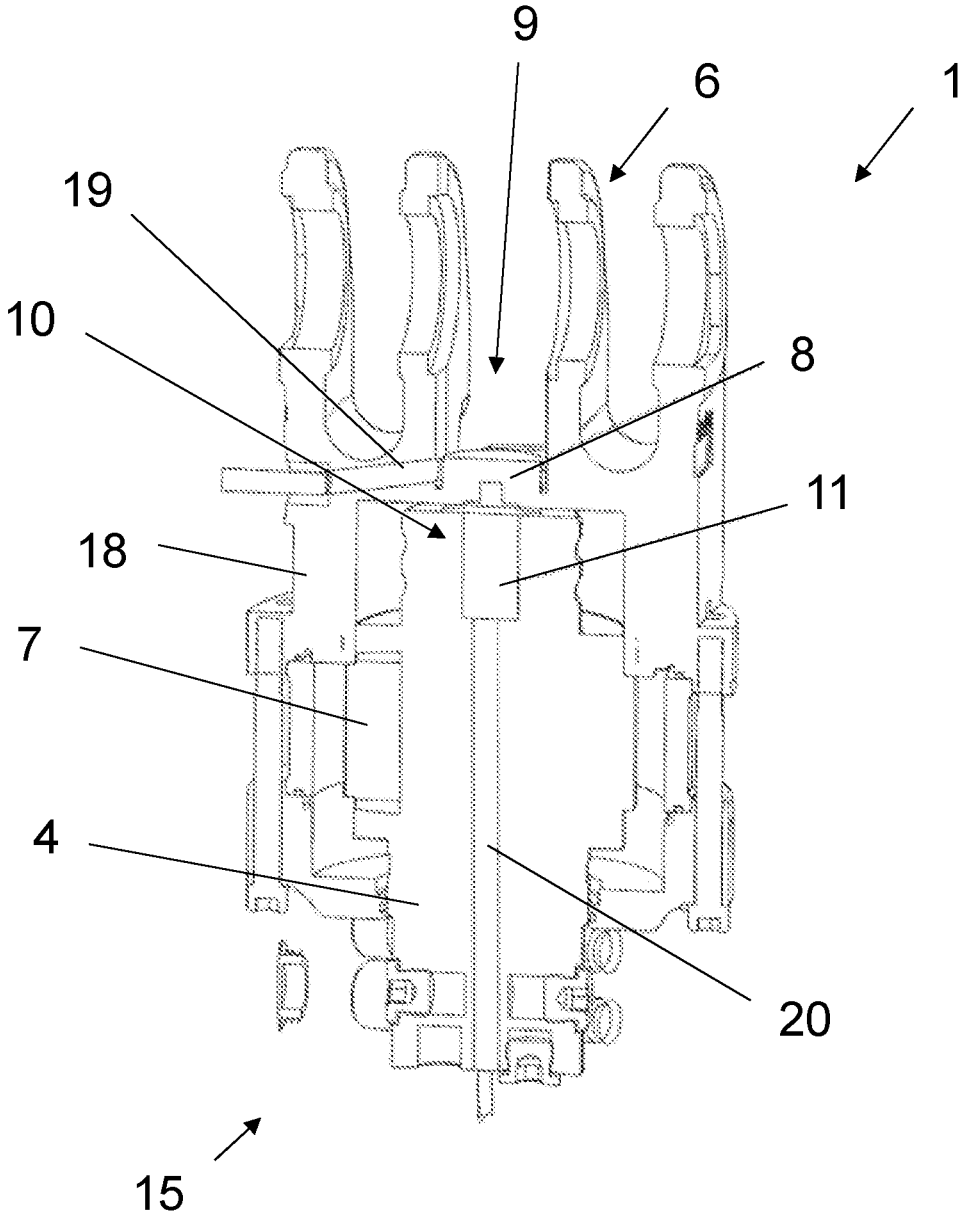
FIG. 2 shows a further sectional representation of the embodiment of the rotational drive of FIG. 1.

A further sectional representation of the embodiment of the rotational drive 1 shown in FIG. 1 is shown in FIG. 2. The section plane of the representation shown in FIG. 2 is running substantially rotated by 90° compared with FIG. 1. Among other things, the recess in the form of a cable duct 19 in the shaft bearing 18, which, as represented, runs substantially radially in the shaft bearing 18, can thereby be seen.

Figure 3:
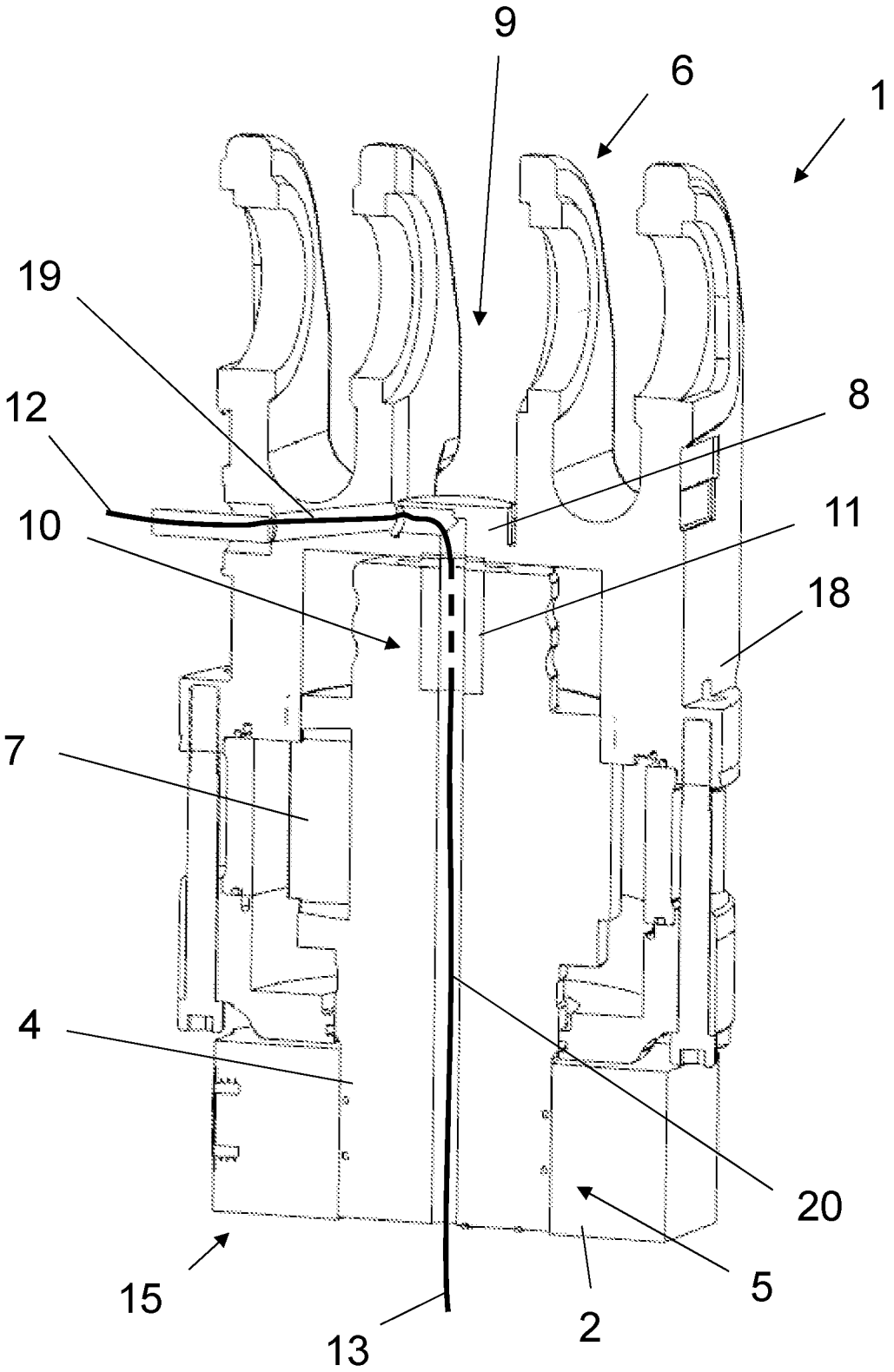
FIG. 3 shows a sectional representation of a second embodiment of a rotational drive.

A second embodiment of a rotational drive 1 is shown in FIG. 3. In the embodiment shown, the shaft bearing 18 again has a first recess 9, in which a rotary encoder 8 is arranged. At its end facing towards the second securing element 6, the shaft 4 has a second recess 10, in which a sliding contact device 11 is arranged. In the embodiment shown in FIG. 2, the first cable duct 19 runs substantially radially in the shaft bearing 18 and also leads substantially radially into the rotary encoder 8. The second axial cable duct 20, which also leads into the rotary encoder 8 axially coming from the shaft 4, runs in the shaft 4. The current supply line 12 to the sliding contact device 11 thus runs substantially radially in the shaft bearing 18 and in some sections radially and in some sections axially in the rotary encoder 8. The current discharge line 13 runs substantially axially in the cable duct 20 of the shaft 4. At the lower end 15 of the rotational drive 1, on the shaft 4 projecting out of the shaft bearing 18, a part of load-handling equipment 2 secured via first securing element 5 is shown (see also FIG. 7 in this regard). The current discharge line 13 exits the (lower as represented) end of the shaft 4 facing towards the first securing element 5 substantially axially.

Figure 4:
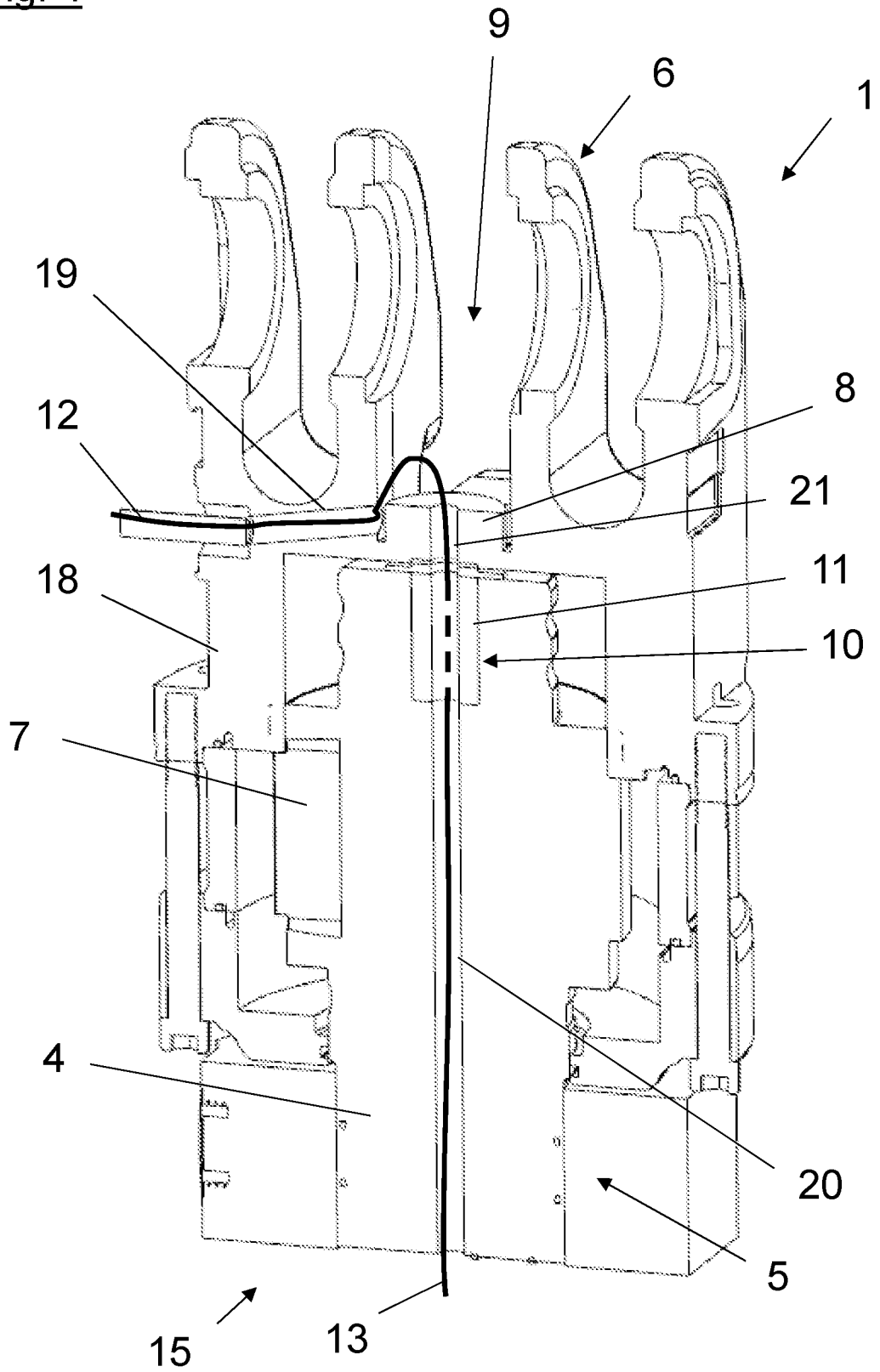
FIG. 4 shows a sectional representation of a third embodiment of a rotational drive.

A third embodiment of a rotational drive 1 is shown in FIG. 4. In the embodiment shown, the shaft bearing 18 again has a first recess 9, in which a rotary encoder 8 is arranged. At its end facing towards the second securing element 6, the shaft 4 has a second recess 10, in which a sliding contact device 11 is arranged. FIG. 4 further shows that the current supply line 12 of the sliding contact device 11 runs substantially radially in the shaft bearing 18 and furthermore crosses the rotary encoder 8 axially through a corresponding axial feedthrough 21. The current discharge line 13 of the sliding contact device 11 runs, as represented, substantially axially in the shaft 4 in the cable duct 20. The current discharge line 13 exits the end of the shaft 4 facing towards the first securing means 5 substantially axially.

Figure 5:
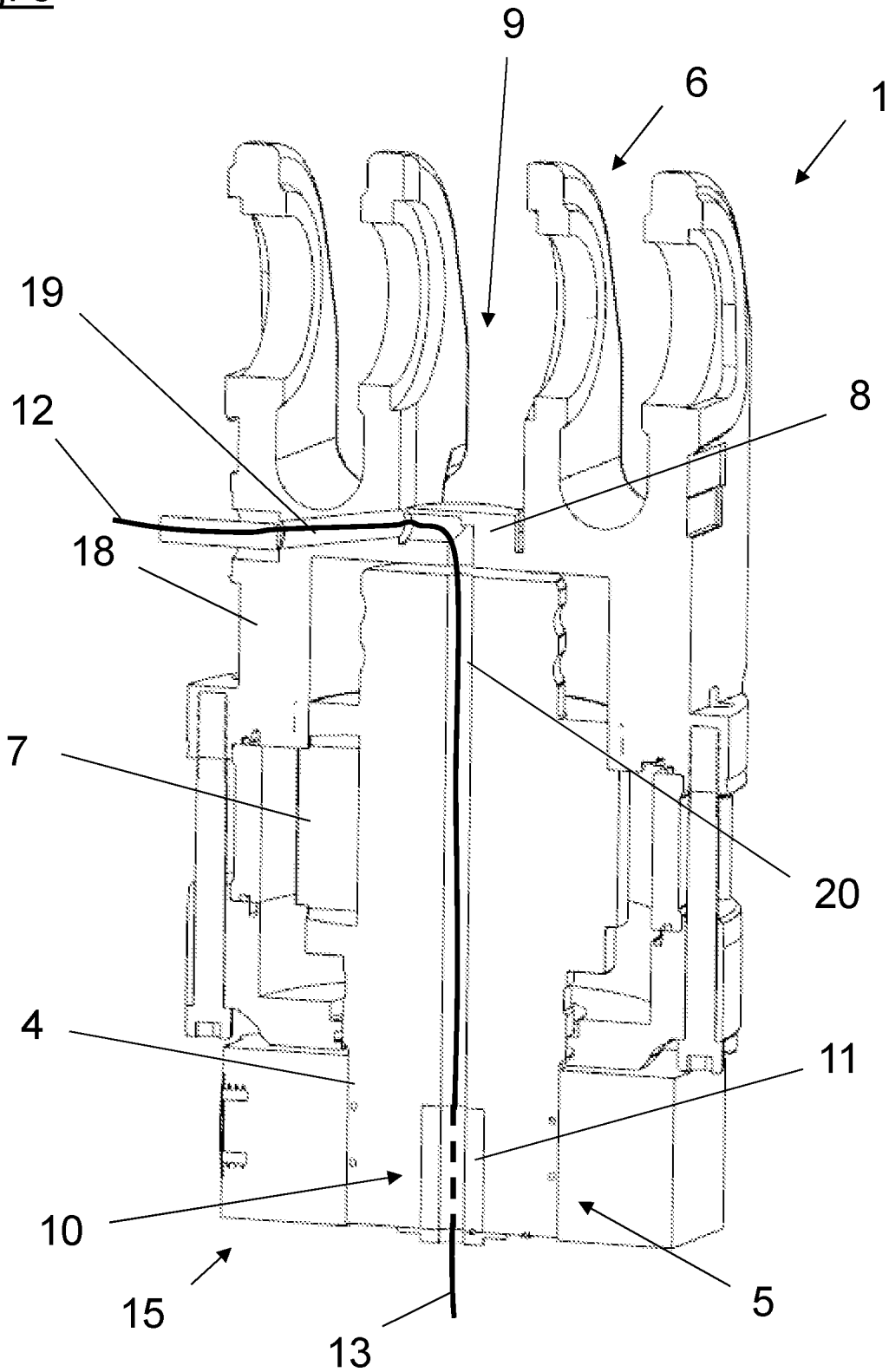
FIG. 5 shows a sectional representation of a fourth embodiment of a rotational drive.

In FIG. 5, a fourth embodiment of a rotational drive 1 is shown, which differs from the embodiment shown in FIG. 3 substantially in that, at an end facing away from the second securing element 6 and facing towards the first securing element 5, the shaft 4 has a second recess 10, in which the sliding contact device 11 is arranged. The rotary encoder 8 is again arranged in the first recess 9 of the shaft bearing 18. In the embodiment shown in FIG. 5, the first cable duct 19 runs substantially radially in the shaft bearing 18 and also leads substantially radially into the rotary encoder 8. The second axial cable duct 20, which also leads into the rotary encoder 8 axially coming from the shaft 4, runs in the shaft 4. The current supply line 12 to the sliding contact device 11 thus runs radially in the shaft bearing 18 and in some sections radially and in some sections axially in the rotary encoder 8. The current supply line 12 also runs axially in the second cable duct 20 of the shaft 4. The current discharge line 13 exits the end of the shaft 4 facing towards the first securing element 5 substantially axially.

Figure 6:
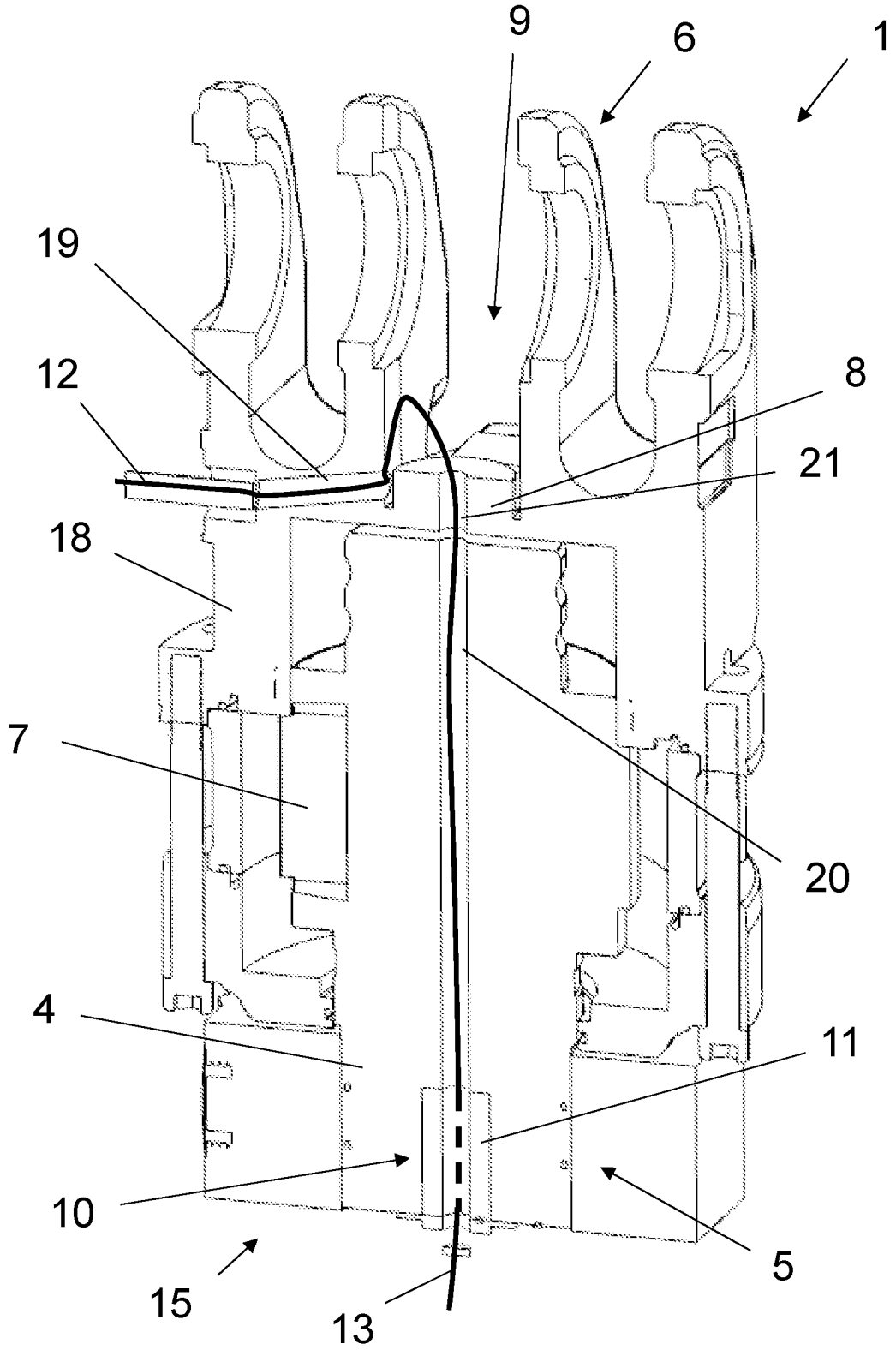
FIG. 6 shows a sectional representation of a fifth embodiment of a rotational drive.

In FIG. 6, a fifth embodiment of a rotational drive 1 is shown, which differs from the embodiment shown in FIG. 4 substantially in that, at an end facing away from the second securing element 6 and facing towards the first securing element 5, the shaft 4 has a second recess 10, in which the sliding contact device 11 is arranged. As in FIG. 4, the rotary encoder 8 has a radial feedthrough 21. The current supply line 12 to the sliding contact device 11, coming from the first radial cable duct 19 running substantially radially through the shaft bearing 18, runs axially through the rotary encoder 8 and runs through the second axial cable duct 20 running substantially axially through the shaft 4 to the sliding contact device 11 arranged, as represented, at the lower end of the shaft 4. The current discharge line 13 exits the end of the shaft 4 facing towards the first securing element 5 substantially axially.

Figure 7:
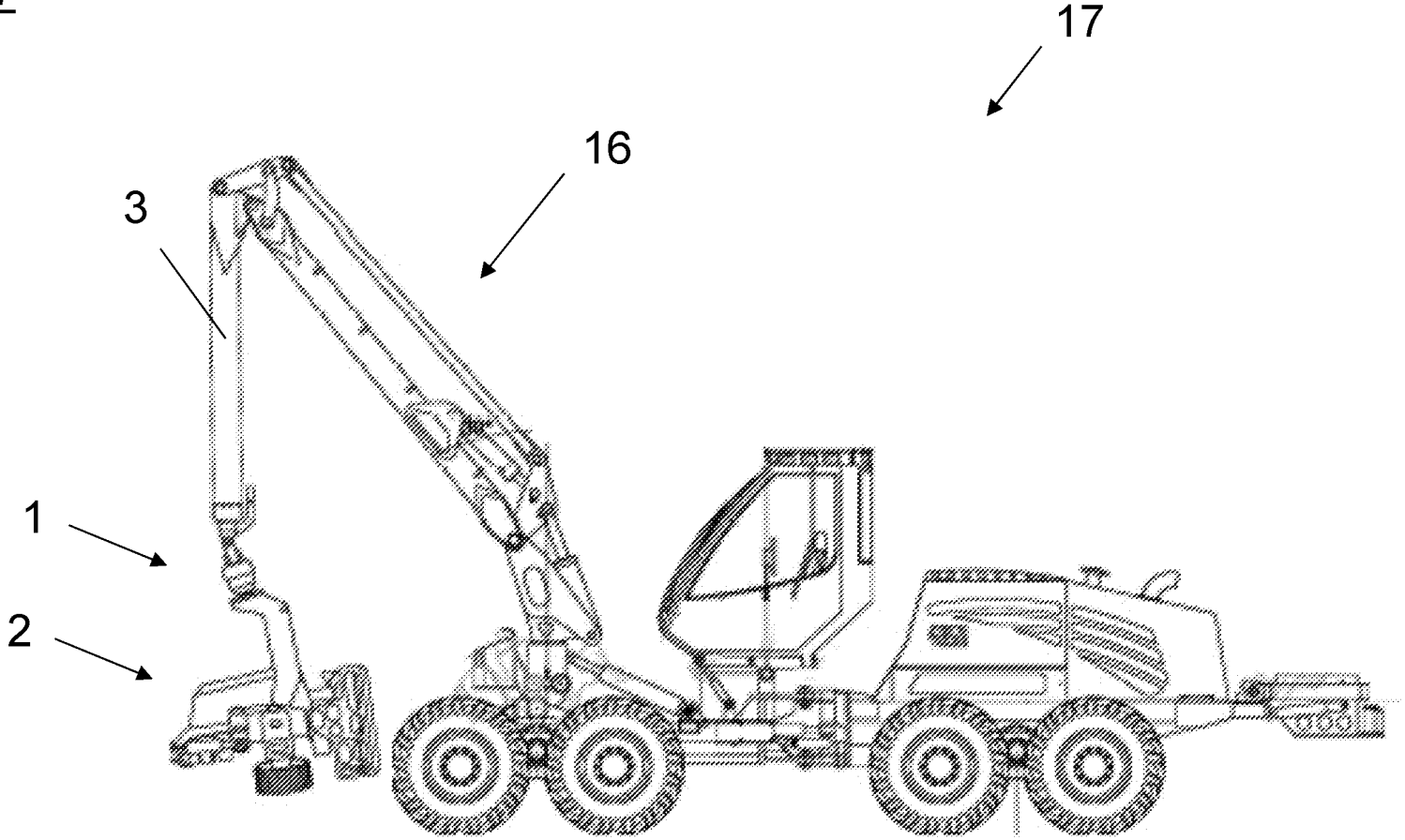
FIG. 7 shows a harvester with a rotational drive.

FIG. 7 shows a side view of a harvester 17, also called timber harvester, forest harvester, or crane harvester. The harvester 17 has a crane 16 with an external crane arm 3. At the crane tip of the crane arm 3, a rotational drive 1 is arranged, to which load-handling equipment 2 is secured. Through the hydraulic rotational drive 1, the load-handling equipment 2 can be rotated relative to the crane arm 3.

Figure 8:
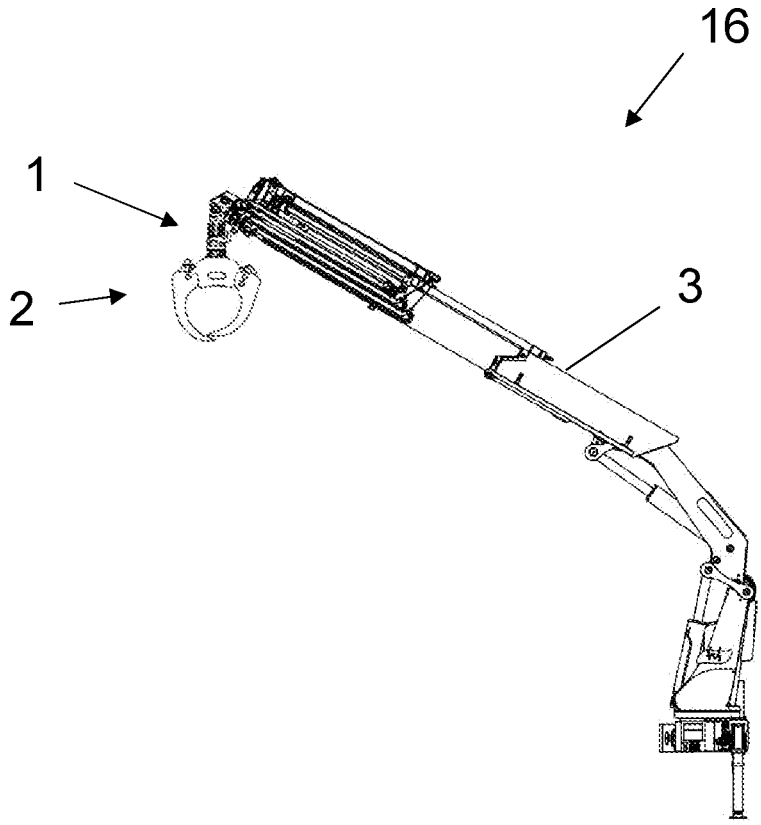
FIG. 8 is a side view of a crane.

In FIG. 8, a side view of a further embodiment of a crane 16 is shown, wherein structurally and functionally similar elements have the same reference numbers as in the embodiment shown previously. In the embodiment shown in FIG. 8, load-handling equipment 2 formed as a grapple is arranged on a telescopic crane arm 3 via a rotational drive 1.

Figure 9:
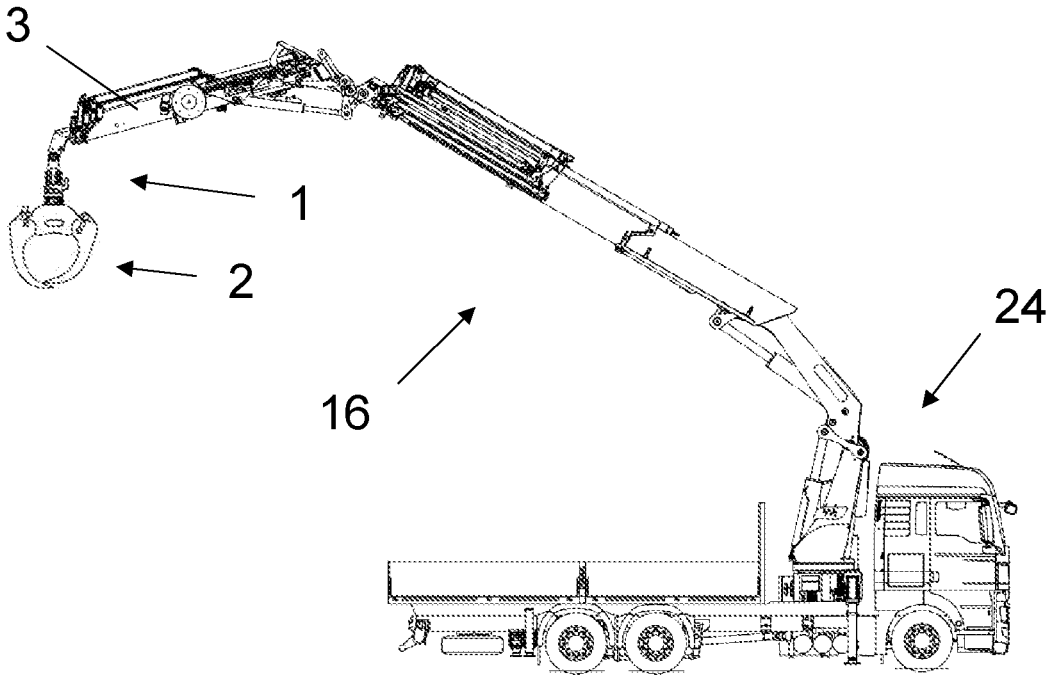
FIG. 9 is a side view of a vehicle with a crane.

In FIG. 9, a vehicle 24 with a further embodiment of a crane 16 formed as a loading crane is shown, wherein structurally and functionally similar elements have the same reference numbers as in the embodiments shown previously. Load-handling equipment 2 formed as a grapple is arranged, via a rotational drive 1, on a crane arm 3, formed as an articulated attachment arm, of the crane 16 arranged on the vehicle 24.

Figure 10:
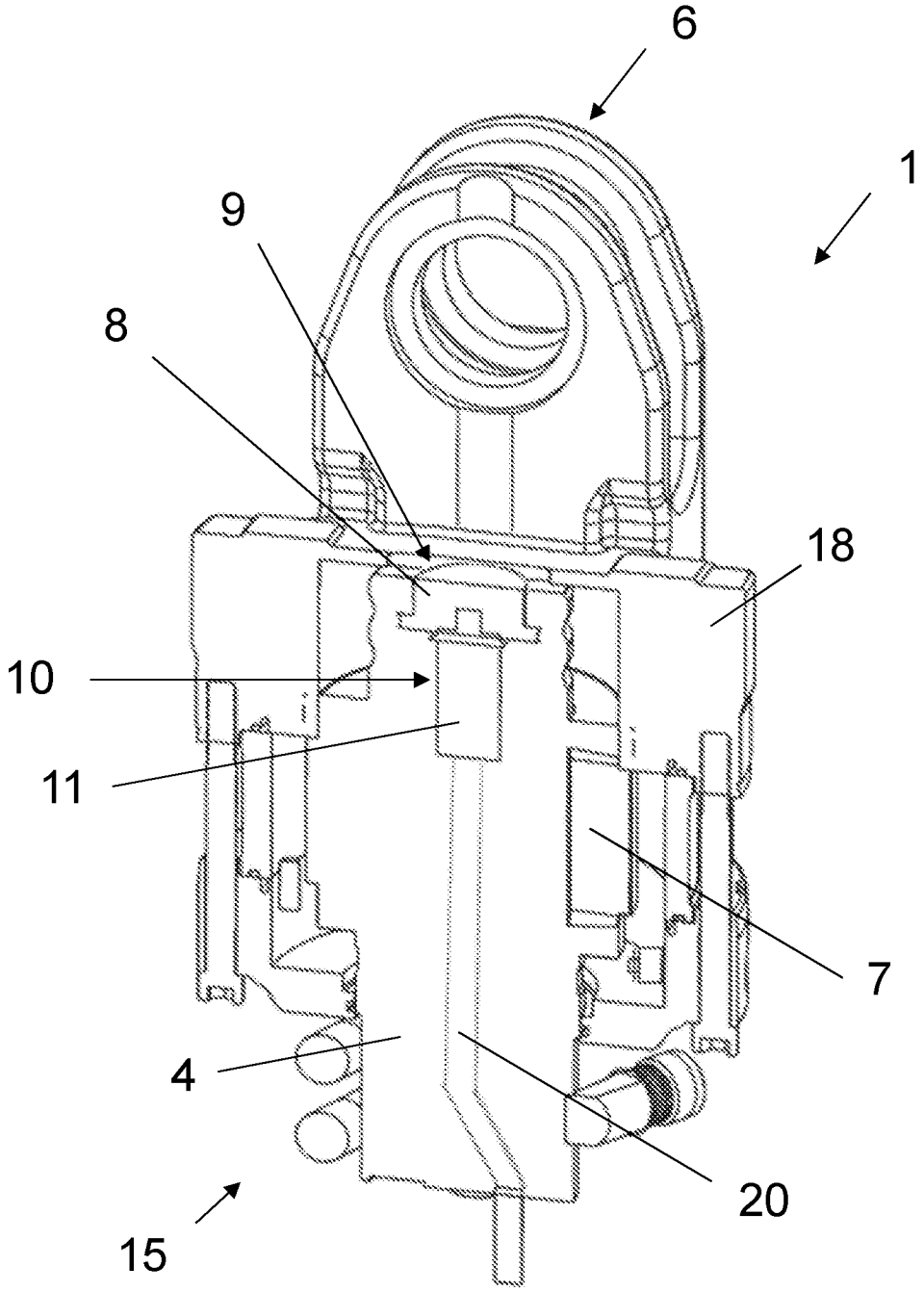
FIG. 10 shows a sectional representation of a sixth embodiment of a rotational drive.
Figure 11:
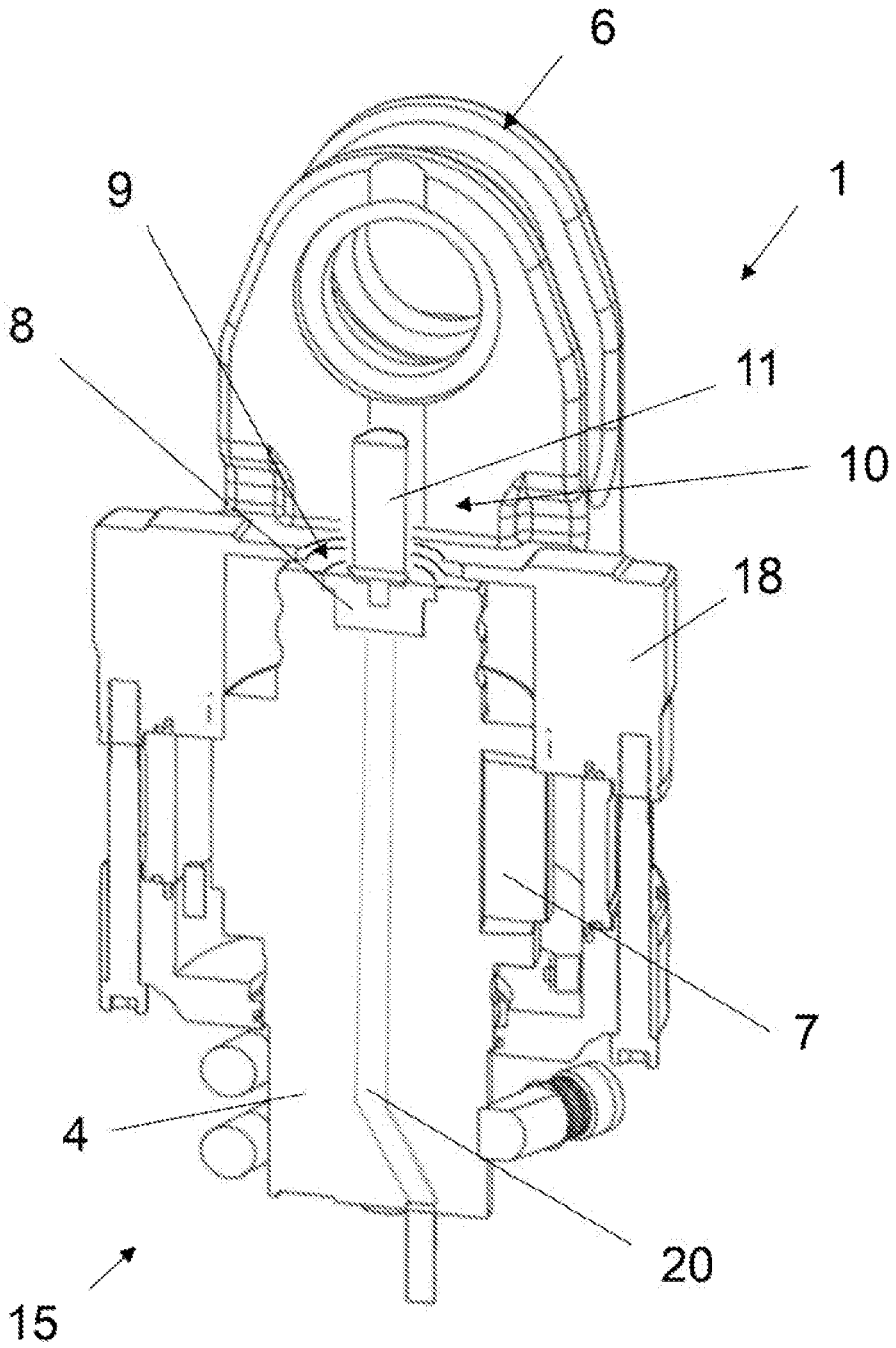
FIG. 11 shows a sectional representation of a seventh embodiment of a rotational drive.

In FIG. 10, a section through a sixth embodiment of a rotational drive 1 is shown. As distinguished from the embodiment shown in FIG. 1, the first recess 9 is provided in the shaft 4, in which the rotary encoder 8 is arranged. The first recess 9 is provided at an (upper as represented) end of the shaft 4 facing towards the second securing element 6. In the embodiment shown, the rotary encoder 8 is provided substantially completely in the first recess 9. Below the first recess 9, the second recess 10 is also provided in the shaft 4, in which the sliding contact device 11 arranged. In the embodiment shown, the sliding contact device 11 is provided substantially completely in the second recess 10. FIG. 11 shows an alternative seventh embodiment in which the first recess 9 is provided at an upper end of the shaft as in the sixth embodiment, but the second recess 10 is provided in the shaft bearing 18. The rotary encoder 8 is at least partially arranged in the first recess 9, and the sliding contact device is at least partially arranged in the second recess 10.

LIST OF REFERENCE NUMBERS

Rotational drive 1
Load-handling equipment 2
Crane arm 3
Shaft 4
First securing means 5
Second securing means 6
Vane 7
Rotary encoder 8
First recess 9
Second recess 10
Sliding contact device 11
Current supply line 12
Current discharge line 13
Detection device 14
End of rotational drive 15
Crane 16
Harvester 17
Shaft bearing 18
Cable duct 19
Cable duct 20
Axial feedthrough 21
Signal line 22
Radio link 23
Vehicle 24

The invention claimed is:

1. A hydraulic rotational drive for rotating load-handling equipment relative to a crane arm, the hydraulic rotational drive comprising:

a shaft having a first securing element for connecting the shaft to the load-handling equipment or the crane arm, a shaft bearing having a second securing element for connecting the shaft bearing to the crane arm or the load-handling equipment, vanes arranged in the shaft, the vanes being configured to be acted on by oil via an oil feed and an oil discharge for the transmission of a torque to the shaft, a rotary encoder for detecting an angular position of the shaft relative to the shaft bearing, and a sliding contact device electrically contacted by a current supply line and a current discharge line, wherein a first recess is provided in the shaft and a second recess is provided in the shaft bearing, the rotary encoder being at least partially received within the second recess and the sliding contact device being arranged at least partially in the first recess.

2. The hydraulic rotational drive according to claim 1, wherein the first recess is arranged on an end of the shaft facing towards or facing away from the crane arm.

3. The hydraulic rotational drive according to claim 1, wherein at least one of the rotary encoder and the sliding contact device is completely received in the respective one of the first recess and the second recess.

4. The hydraulic rotational drive according to claim 1, wherein transmission of the angular position detected by the rotary encoder to a detection device is effected via cables or wirelessly.

5. The hydraulic rotational drive according to claim 1, wherein the current supply line to the sliding contact device runs substantially axially in the shaft and/or runs substantially radially in the shaft bearing.

6. The hydraulic rotational drive according to claim 5, wherein the current supply line to the sliding contact device runs substantially axially or radially in the rotary encoder.

7. The hydraulic rotational drive according to claim 1, wherein, at an end of the rotational drive facing towards the load-handling equipment, the shaft projects beyond the shaft bearing.

8. A crane comprising the hydraulic rotational drive according to claim 1 and the crane arm, wherein the crane arm is connected to the second securing element of the hydraulic rotational drive.

9. A harvester with the crane according to claim 8.

10. The hydraulic rotational drive according to claim 1, wherein the first recess is provided in the shaft on a central axis thereof, and a second recess is provided in the shaft bearing on a central axis thereof.

11. A hydraulic rotational drive for rotating load-handling equipment relative to a crane arm, the hydraulic rotational drive comprising:

a shaft having a first securing element for connecting the shaft to the load-handling equipment or the crane arm, a shaft bearing having a second securing element for connecting the shaft bearing to the crane arm or the load-handling equipment, vanes arranged in the shaft, the vanes being configured to be acted on by oil via an oil feed and an oil discharge for the transmission of a torque to the shaft, a rotary encoder for detecting an angular position of the shaft relative to the shaft bearing, and a sliding contact device electrically contacted by a current supply line and a current discharge line, wherein the shaft has a first recess located on a central axis of the shaft, and the shaft bearing has a second recess, and wherein the sliding contact device is at least partially received in the second recess, and the rotary encoder is at least partially received in the first recess.

* * * * *